United States Patent [19]

Gibbons

[11] Patent Number: 5,011,437

[45] Date of Patent: Apr. 30, 1991

[54] BATTERY TERMINAL CONNECTOR

[76] Inventor: Darvin C. Gibbons, 1528 Lakeview Cir., Morristown, Tenn. 37814

[21] Appl. No.: 427,709

[22] Filed: Oct. 27, 1989

[51] Int. Cl.[5] ..... H01R 11/24

[52] U.S. Cl. ..... 439/759; 439/761

[58] Field of Search ..... 439/759–761, 439/766, 909, 504

[56] References Cited

U.S. PATENT DOCUMENTS

| | | | |
|---|---|---|---|
| 3,118,719 | 1/1964 | Overby | 339/226 |
| 3,204,216 | 8/1965 | Ausherman | 339/237 |
| 3,259,280 | 9/1970 | Best | 339/226 |
| 3,456,181 | 7/1969 | Godshalk | 439/504 |
| 3,478,306 | 11/1969 | McCray | 339/237 |
| 3,521,223 | 7/1970 | Martinez | 439/761 |
| 3,694,798 | 9/1972 | Julian | 339/237 |
| 3,745,516 | 7/1973 | Lieberman | 339/228 |
| 4,174,873 | 11/1979 | Hargett et al. | 339/130 R |
| 4,342,497 | 8/1982 | Morrison | 339/228 |
| 4,576,430 | 3/1986 | Dufresne | 439/759 |
| 4,595,842 | 6/1986 | Soloway | 339/239 |
| 4,760,000 | 7/1988 | Williams | 39/754 |
| 4,826,457 | 5/1989 | Varatta | 439/759 |

*Primary Examiner*—Paula A. Bradley

*Attorney, Agent, or Firm*—Pitts and Brittian

[57] ABSTRACT

An improved connector for connecting an electrically conductive cable to the terminal post of a wet-cell storage battery in such a manner as to facilitate quick connection and disconnection therebetween while maintaining the permanency characteristics possessed by similar connectors in use prior to the present invention.

16 Claims, 4 Drawing Sheets

BATTERY TERMINAL CONNECTOR

TECHNICAL FIELD

This invention relates to electrical connectors generally and more particularly concerns a wet-cell storage battery connector which possesses the advantage of a manually operated quick release feature while retaining the permanency characteristics of similar connectors in common use prior to the present invention

BACKGROUND ART

Over the years since the invention of the lead-acid, wet-cell storage battery, a variety of devices have been created to interface it to the electrical circuits receiving power from it. The device most commonly in use for making an electrical connection with the terminal post of this type of battery is the open center, split-clamp, lead-alloy type connector. The split in the clamp is to allow flexing in attaching the clamp to, and removing it from, a battery terminal post, which is received by the clamp's open center. The usual method of clamping the connector to the terminal post is through the use of a nut and a bolt to pull the two halves of the split clamp together and hold them against the terminal post under pressure. However, this device suffers from material deterioration caused by corrosion. This deterioration usually results in the fusing of the nut, bolt, and clamp into a semi-unitary object, causing much difficulty in removing such a clamp from contact with the battery terminal post and often precludes its reuse.

Several attempts have been made to provide a device which accomplishes the electrical connection function of the device described above, but which also possesses quick connect and disconnect capabilities. Prior to the present invention, none of the prior art has fully realized this goal.

The following listed U.S. Patents have been compared with the art described in the present invention, and are exemplary of the shortcoming just mentioned in the preceding paragraph: U.S. Pat. Nos. 3,521,223, 3,118,719, 3,204,216, 3,478,306, 3,529,280, 3,694,798, 3,745,516, 4,174,873, 4,342,497, 4,760,000, and 4,595,842.

Accordingly, it is a principal object of the present invention to provide a device which will form a secure electrical connection between an electrically conductive cable and the terminal post of a wet-cell storage battery.

It is another object of the present invention to provide a device which will form such secure electrical connection between an electrically conductive cable and a wet-cell storage battery terminal post and yet be quickly detachable upon the application of manual force, such as a squeeze, or the like.

It is another object of the present invention to provide such a secure electrical connection with automatic spring-tensioned self-compensation for loss of material due to wear and/or corrosion.

It is another object of the present invention to provide a device which will form a secure electrical connection between a cable and a battery post, as just described above, in a quick connect and disconnect manner while possessing integral insulation against accidental electrical contact with other objects.

It is another object of the present invention to provide such a device which will retain the secure electrical contact and permanency characteristics of similar connectors in use prior to the present invention by providing inner lining walls of appropriate material, shape, and size, preferably replaceable, to fit storage battery terminal posts.

Other objects and advantages will be accomplished by the present invention which is described in more detail in the following paragraphs.

DISCLOSURE OF THE INVENTION

An improved connector for connecting an electrically conductive cable to the terminal post of a wet-cell storage battery in such a manner as to facilitate quick connection and disconnection therebetween while maintaining the permanency characteristics possessed by similar connectors in use prior to the present invention.

A device constructed in accordance with various features of the present invention is provided, comprising two channel-shaped arm members, formed of some rigid material, which can be either conductive or non-conductive, similar in shape to the alligator-clip handles on the familiar jumper cables. The tips of these two arms comprise jaw sections at a first end and handle sections at the distal end. These arms are shaped and formed so as to enclose and retain a replaceable lining member within the interior portions of their jaw ends. The arm members are joined together at their approximate centers, forming a common axis point, around which the ends of the arm members are caused to rotate in opposite directions from each other. An attachment means is integrally formed in at least one of the arm members for the purpose of attaching an electrically conductive wire or multi-strand cable.

The arm members are perforated at the common pivoting point so as to receive an axially operating retaining means, which can be a nut and bolt, rivet, rod, or such like device passing through the common pivot point.

The arm members are biased into physical contact at their jaw tips by a biasing means which can be one of various types of springs. In one embodiment, this biasing means comprises a wire coil spring member with a hollow center or core. Of course, it will be quickly seen that various types of springs could be utilized to accomplish the same purpose. One alternate embodiment could include a "C" clip or pull type coil spring across the jaw opening instead of around the axis means. Another method could include the use of a compression spring inserted between the handles.

In the axial type embodiment, the biasing member is located between the arm piece members, with the axial pivoting member passing through its hollow center, its extended ends pressing outwardly against the interior walls of the handle members, causing the jaw openings to be biased to the closed position and the jaw linings to be pressed into solid physical and electrical contact with the battery post when such is inserted therebetween.

The lining of the jaw members, in a preferred embodiment, is comprised of a single piece of electrically conductive material, such as lead-alloy, for instance, conformably shaped so as to circumscribe, and form electrical contact with, the maximum possible surface area of a terminal post of the type of electrical storage battery commonly known as a wet-cell. The lining is divided on that portion of its periphery proximate to and corresponding in alignment with the opening of the jaw members. Opposite the jaw opening made in the lining, a vertical slot provides strain relief for the flexing encountered in the opening and closing. The lining member could contain an extension manufactured to extend beyond the jaw members for the purpose of accepting a "C" type clip spring or a push type coil spring, for instance, as an alternate biasing means.

In one embodiment, an electrical connection means is inserted into a receptacle formed in the lining wall distal from the slotted opening and proximate the strain relief slot to ensure adequate conduction between both sides of the jaw lining. The lining can be removably secured to the jaw members by means of screws inserted therethrough, external spring or clamp means, or other devices. In one preferred embodiment, the top and bottom edges of the jaw and arm members can be formed into overlapping lips which, cooperatively with the curvature of the jaw portions in front and the biasing spring or the pivot axis in the back, define a volume within which the lining member can be securely retained. As the jaw portions are forced toward each other by the pressure of the spring biasing means, the inner lining, likewise carried by the force of the biasing means, is pressed around the battery terminal post. The inner lining being electrically connected with an electrically conductive cable by some suitable means, such as soldering or swaging, for instance, the desired result of transferring power to and from the battery can be accomplished.

The electrical wire or cable connecting means can be equipped with various types of electrical connectors, including plug-ins, terminal lugs, an in-line fuse, or combinations of these or others.

In a preferred embodiment, the handle members can be squeezed together between the thumb and fingers of one hand, forcing the jaws apart and widening the open jaw slot in the lining member, both of which are then in a position to circumscribably receive the terminal post of the storage battery or, conversely, to be detached from the same.

In an embodiment wherein the arm members are composed of conductive material, the lining, the arms, jaws, and handles are all in electrically conductive contact with the electrical cable. Some insulating material can be used to cover the handles in order to prevent short circuits to other conductive objects. In an embodiment utilizing arm members made of non-conductive material, an electrical connection is established between the conductive cable and at least one side of the inner lining of the jaw portions.

BRIEF DESCRIPTION OF THE DRAWINGS

The above-mentioned features of the invention will become more clearly understood from the following detailed description read together with the drawings in which.

BEST MODE FOR CARRYING OUT THE INVENTION

An improved connector for connecting an electrically conductive cable to the terminal post of a wet-cell storage battery in such a manner as to facilitate quick connection and disconnection therebetween while maintaining the permanency characteristics possessed by similar connectors in use prior to the present invention. An improved battery cable connector, incorporating various features of the present invention, is illustrated generally at 10 in the Figures, in which like numerals designate like objects.

Figure 1:
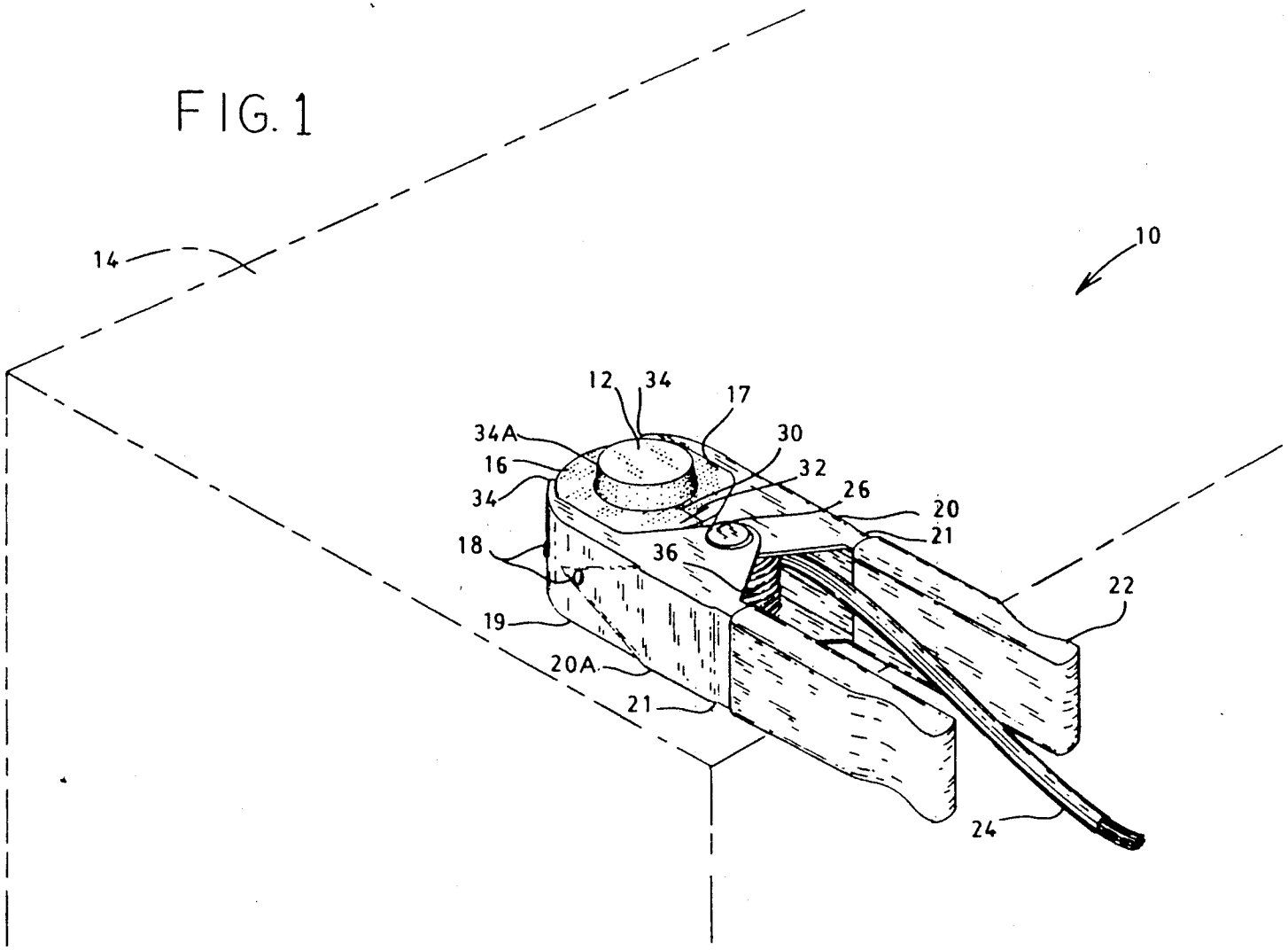
FIG. 1 is a pictorial representation of a device constructed in accordance with various features of the present invention shown in a typical installation.
Figure 2:
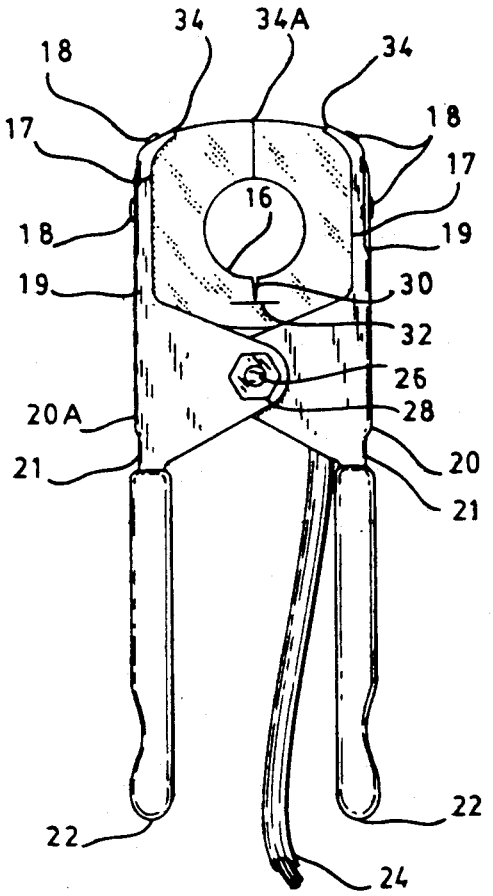
FIG. 2 is a top view of such a device.
Figure 3:
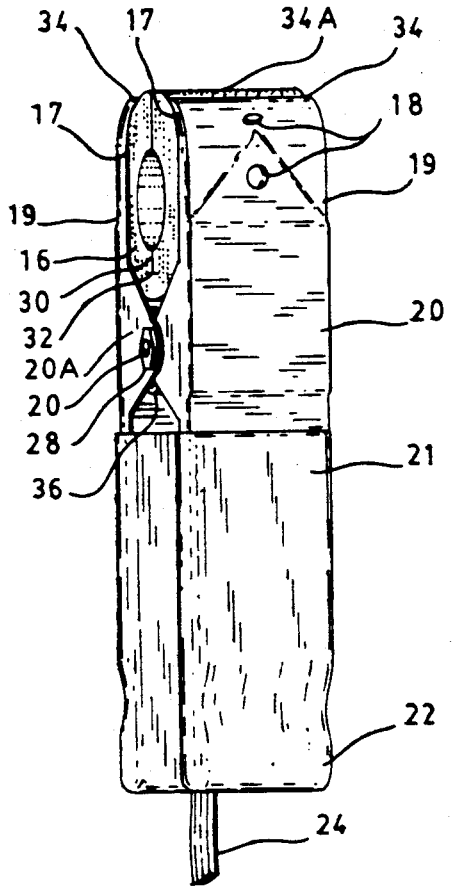
FIG. 3 is a side view of such a device.
Figure 4:
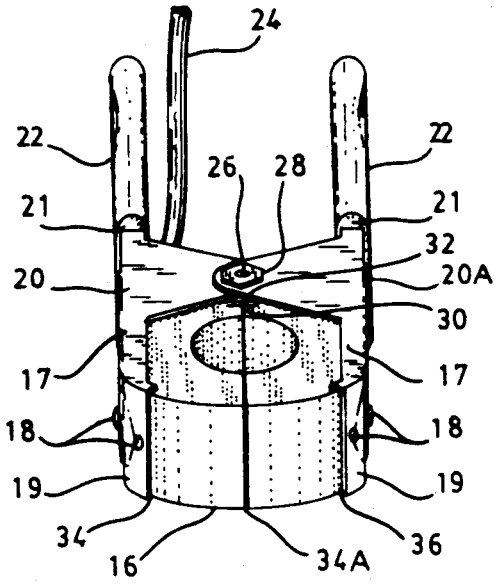
FIG. 4 is a perspective end view of such a device.

In FIG. 1, the device 10 is pictorially illustrated in a typical installation, attached to the terminal post 12 of a wet-cell storage battery 14, represented by the phantom lines. In this position, the device 10 is able to accomplish the function of transferring power between the battery 14 and the electrical circuit of the battery's vehicle through the device 10 and electrical conductor 24.

To enable device 10 to accomplish this task, arm members 20, 20A are provided, these arm members 20, 20A comprising jaw portions 19 at a first end, and handle portions 21 at the distal end. Arm members 20, 20A can be formed of some rigid material, either electrically conductive or non-conductive, preferably with their top and bottom edges formed at right angles to their major surfaces to provide rigidity. The overlapping lip 17 thus formed is further useful in helping to retain replaceable inner lining member 16 within the jaw portion 19 of arm members 20, 20A. An attachment means (not shown) is integrally formed in at least one of arm members 20, 20A to provide for at least the physical connection of conductor 24.

Jaw portions 19 of arm members 20, 20A are shaped and formed so as to enclose and retain a replaceable jaw lining member 16. In one embodiment, jaw portions 19 can extend into jaw opening 34 to further enclose lining member 16. Jaw portions 19 are caused to operate opposably to handle portions 21 by means of pivot axis 26.

The opposable operation of handle portions 21 against jaw portions 19 is accomplished by joining arm members 20, 20A at pivot axis 26 by an axially operating retaining means, which can be a nut 28 and bolt, rivet, rod, or such-like device passing through pivot axis 26.

Figure 8:
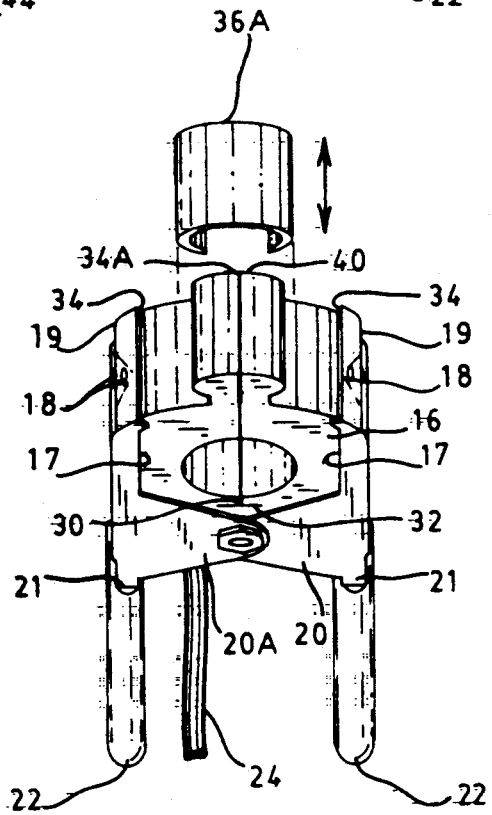
FIG. 8 illustrates a "C" clip type of alternate biasing means.

Jaw lining member 16, in a preferred embodiment, is comprised of a single piece of electrically conductive material, such as a lead alloy, for instance, conformably shaped so as to circumscribe, and form electrical contact with, the maximum possible surface area of the terminal post 12 of the type of electrical storage battery 14 known as a wet cell. Lining member 16 has a vertically disposed jaw opening 34A cut into that portion of its periphery proximate to and corresponding in alignment with the opening 34 of jaw portions 19. On the opposite side of opening 34A, a vertically disposed slot 30 is cut in lining member 16 to provide relief from the strain imposed by repeated openings of jaw portions 19. As a protection against the loss of contact surface area which would result should lining member 16 break into two pieces as a result of such strain, an electrical conductor is inserted into a receptacle 32 formed in the body of lining 16 proximate strain relief slot 30. Lining member 16 also could contain an extension 40 manufactured to extend beyond jaw portions 19, as shown in FIG. 8, for the purpose of accepting a "C" clip spring 36A, for instance, as alternate biasing means.

Liner 16 can be removably secured to jaw portions 19 by means of screws 18 inserted therethrough, clamp 36A, or by other means. In one preferred embodiment, the top and bottom edges of arm members 20 and 20A are bent at right angles to form retaining surfaces 17 which, cooperatively with the curvature of jaw portions 19 in front and pivot axis 26 in back, prevent liner 16 from moving substantially out of place.

In an embodiment wherein arm members 20, 20A are composed of conductive material, lining 16, arms 20, 20A, jaws 19, and handles 21 are all in electrically conductive contact with the electrical cable 24. Insulating material 22 can be used to cover handles 21 in order to prevent short circuits to other conductive objects In an embodiment utilizing arm members 20, 20A made of non-conductive material, an electrical connection is established between the conductive cable 24 and at least one side of inner lining 16 of jaw portions 19 by some suitable means, such as soldering, swaging, or the like.

As best illustrated in FIGS. 5A, 5B, 5C, and 6, various embodiments are also possible with regard to the means of attaching/interfacing with electrical conductor 24.

Figure 5C:
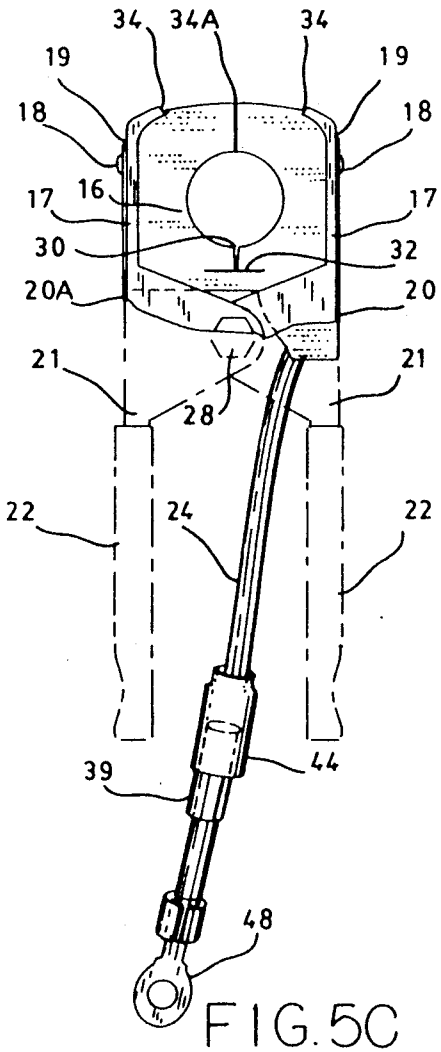
FIG. 5C is a partial cutaway top view showing a conductor with the terminal lug of FIG. 5B.
Figure 5B:
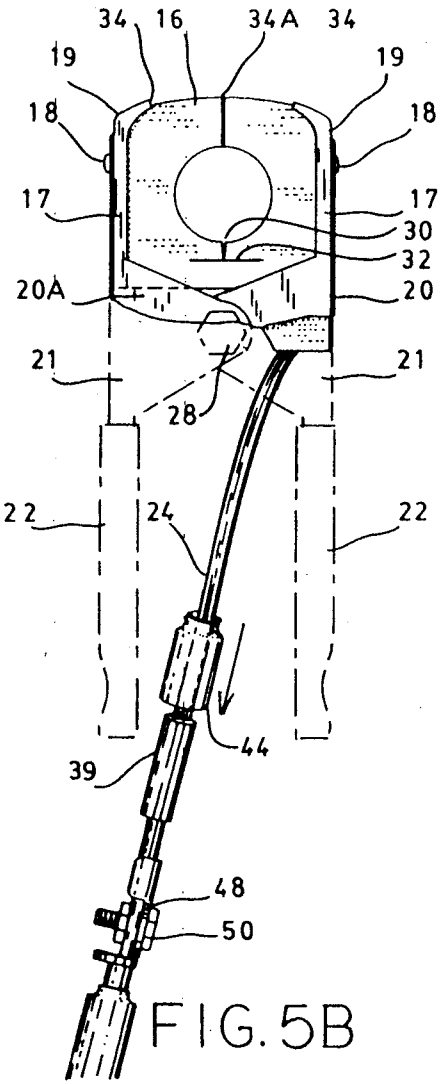
FIG. 5B is a partial cutaway top view showing a conductor with a terminal lug attached to another conductor by a nut and bolt.
Figure 5A:
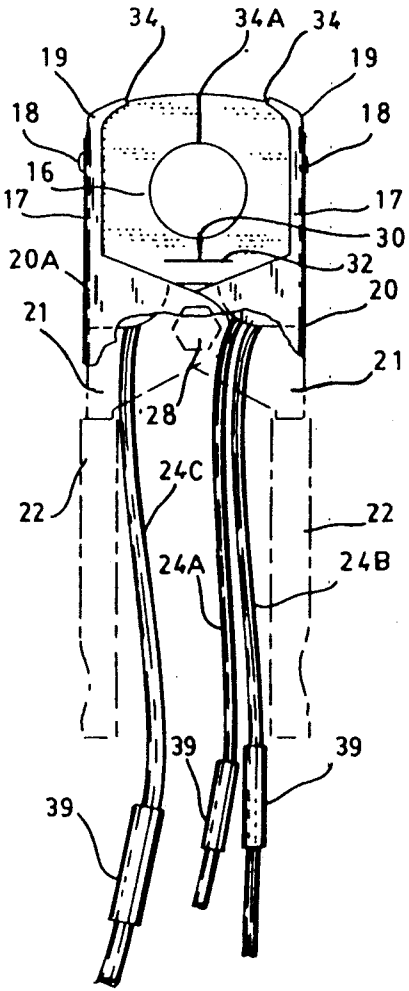
FIG. 5A is a partial cutaway top view showing multiple conductors attached to the device.

The illustration in FIG. 5A applies to vehicles having a pluralitY of conducting cables for attachment to the device 10. As shown, two such conductors 24A, 24B are attached to arm member 20 and one conductor 24C is attached to arm member 20A. Connections between conductors 24 and the vehicle electrical wiring are made through tubular connectors 39, which can be crimp-on types and are preferably insulated. Of course, the embodiment shown is only exemplary of many possible variations.

FIG. 5B shows the installation of a terminal lug 48 in cooperative association with a nut and bolt attachment 50 and an insulating sleeve 44. Tubular connector 39 is an optional embodiment.

Figure 6:
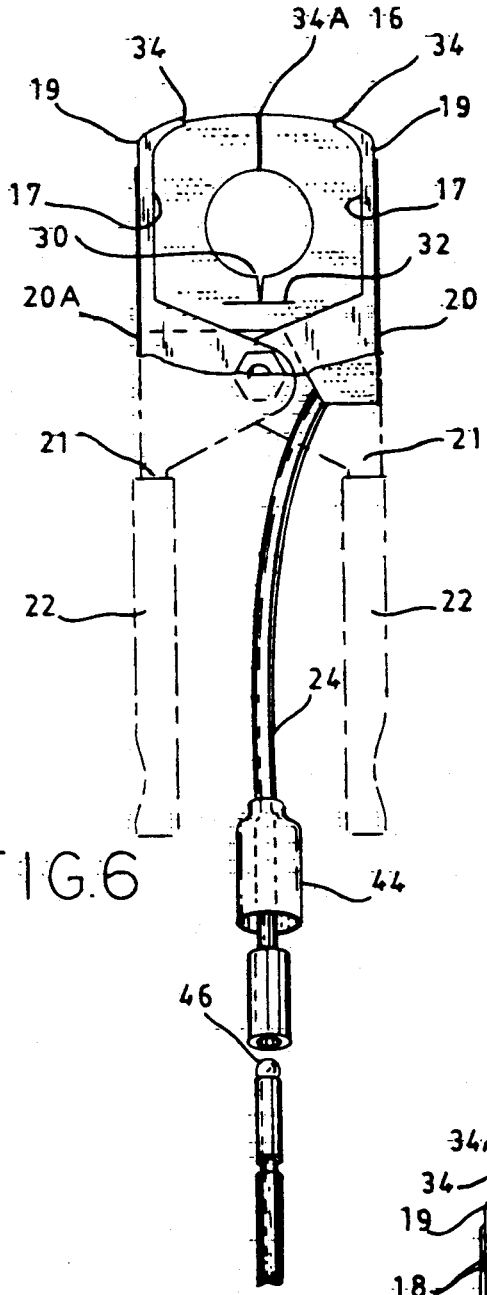
FIG. 6 illustrates a a conductor with a quick-disconnect, plug-in type of connection to the wiring.

Likewise in FIG. 5C, optional connectors 39 are linked to the same terminal lug 48 which is shown without an attachment, and rotated 90 degrees. Terminal lug 48, of course, is only illustrative of many possible varieties of terminal lug in common use in the field FIG. 6 shows a ball and socket type, quick-disconnect, plug-in connector 46 with insulating sleeve 44. Plug-in connector 46 is also intended only as an exemplar of many types and styles of quick-disconnect connectors.

Figure 7:
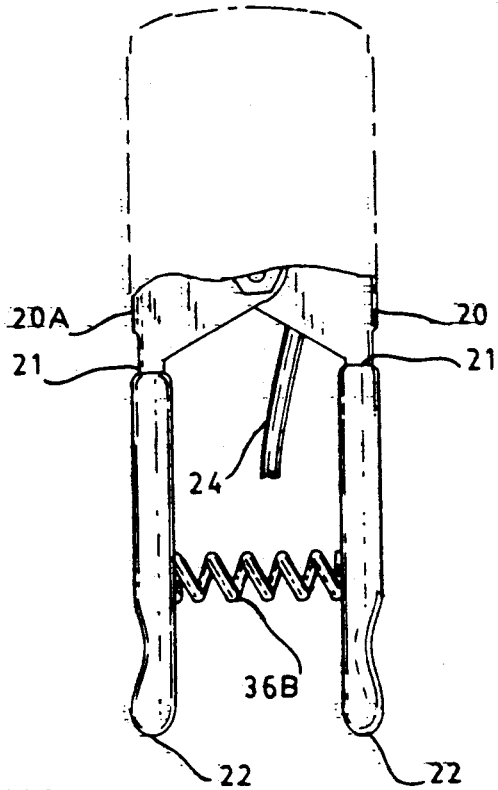
FIG. 7 illustrates a push-type spring biasing means alternate embodiment.

A biasing means operates to hold jaw portions 19 in the closed position. This biasing means can be any of various types of springs, for instance In one embodiment, this biasing means comprises a wire coil spring member 36 with a hollow center or core. Of course, it will be quickly seen that various types of devices could be utilized to accomplish the same purpose. One alternate embodiment could include a "C" type clip 36A across jaw opening 34A instead of around axis 26 as shown in FIG. 8. A further embodiment could include the use of a compression type spring 36B between handle portions 21 as best seen in FIG. 7. In this embodiment, opposite ends of spring 36B could be attached to the respective interior walls of handle portions 21 of arm members 20, 20A. This configuration would have the same end result, that of biasing jaw portions 34, 34A closed by forcing handle portions 21 apart.

In the axial type embodiment, biasing member spring 36 is located between arm members 20 and 20A, with pivot axis 26 passing through its hollow center, its extended ends pressing outwardly against the interior walls of handle portions 21, causing jaw openings 34, 34A to be biased closed and the walls of lining 16 to be pressed into solid physical and electrical contact with battery post 12 when the same is inserted therebetween.

In use, to attach or detach the device 10, arm members 20, 20A are gripped and squeezed together at the handle 21 portion ends. As arm members 20, 20A pivot about pivot axis 26, which is axial through the center of nut 28, handles 21 are forced together. As handles 21 are forced together, jaw portions 19 are forced apart at openings 34, along with the opening 34A in lining 16. The device 10 can then be placed around the terminal post 12 or lifted away from it, as the case may require. When handles 21 are not being squeezed, the spring member 36 provides a biasing force in the direction opposite that imposed during squeezing, which holds jaws 19 closed at 34 and 34A, with handle portions 21 held apart. Lining 16, also carried by the force of biasing means 36, is thus held in firm contact with the maximum possible surface area of battery terminal post 12. Electrical current is then enabled to flow freely between the battery terminal post 12 and electrical conductor 24 through device 10.

From the foregoing detailed discussion, it will be seen that a battery clamp designed for permanent-type installation but which is capable of being quickly connected to or disconnected from the terminal of a wet-cell storage battery has been described. While a preferred embodiment of a device constructed in accordance with various features of the present invention has been described herein, it will be understood that no intent has been made to limit the invention to such disclosure, but rather the intention of such disclosure has been to cover all modifications and alternate constructions falling within the spirit and scope of the invention as defined in the appended claims.

Accordingly, this invention is limited only by the claims appended hereto, and their equivalents, when taken in combination with the complete description contained herein.

I claim:

1. An improved connector for connecting an electrically conductive cable to the terminal post of a wet-cell storage battery to facilitate quick connection and disconnection therebetween, comprising:

attaching means for accomplishing physical and electrical connections to said electrically conductive cable;

opposably disposed operable jaw pieces containing inner lining walls of conductive material specially shaped and sized for circumscribing and contacting said terminal post of said storage battery;

positive electrical contact means for ensuring positive electrical connection between the two sides of said inner lining should said inner lining separate into two pieces physically;

biasing means for holding said inner lining clamped against said terminal post of said storage battery under constant tension; and releasing means for opposably operating said jaw pieces against said biasing means to release said connector from contact with said terminal post of said storage battery.

2. The device of claim 1 wherein said conductive inner wall lining is replaceable.

3. The device of claim 1 wherein said arm piece members are made of non-conductive material.

4. The connector of claim 1 wherein said inner lining is an integral part thereof.

5. The connector of claim 1 wherein said connector is detachable from said electrically conductive cable for replacement purposes.

6. The connector of claim 1 wherein said inner lining is removable and replaceable.

7. A wet-cell storage battery cable clamp, comprising:

opposably operated arm pieces having jaw members containing an electrically conductive inner lining shaped and sized so as to circumferentially make physical and electrical contact with the terminal post of said storage battery;

attaching means for making physical and electrical connections to an electrically conductive cable;

electrical continuity means for ensuring positive electrical connection between the two sides of said inner lining should said inner lining separate into two pieces physically;

tensioning means for maintaining said inner lining in contact with said terminal post under constant tension; and tension releasing means whereby said jaw pieces can be operated to quickly attach or detach said inner lining from contact with said terminal.

8. The device of claim 7 wherein said conductive inner wall lining is replaceable.

9. The device of claim 7 wherein said arm piece members are made of non-conductive material.

10. A quick attach and release battery terminal post clamp, comprising:

opposably operated arm pieces having jaw members containing linings made of electrically conductive material shaped and sized so as to circumferentially make physical and electrical contact with said battery terminal post;

electrical continuity means for ensuring positive electrical connection between the two sides of said lining of said jaw members should said lining separate into two pieces physically;

attaching means for making physical and electrical connections to an electrically conductive cable;

tensioning means for maintaining pressure to hold said linings into contact with said terminal post; and detensioning means for opposing said tensioning means when making or breaking said contact with said terminal post.

11. The device of claim 10 wherein said conductive inner wall lining is replaceable.

12. The device of claim 10 wherein said arm piece members are made of non-conductive material.

13. An improved connector for connecting an electrically conductive cable to the terminal post of a wet-cell storage battery to facilitate quick connection and disconnection therebetween, comprising:

attaching means for accomplishing physical and electrical connection to said electrically conductive cable;

opposably disposed operable jaw pieces, each one of said jaw pieces attached to one side of a one-piece, replaceable inner lining of conductive material having a substantially central portion thereof cut out for circumferentially contacting said terminal post of said storage battery, each said side of said inner lining being movable with said operatively associated jaw piece to which it is attached whereby selective actuation of said jaw pieces moves said inner lining into and out of contact with said terminal post;

biasing means for holding said inner lining clamped against said terminal post of said storage battery under constant tension; and releasing means for opposably operating said jaw pieces against said biasing means to move said lining out of contact with said terminal post and release said connector from said terminal post of said storage battery.

14. The lining of claim 13 having a positive electrical contact means for ensuring positive electrical connection between the sides of said inner lining should said inner lining separate into two pieces physically.

15. The replaceable lining of claim 13 wherein said replaceable lining is shaped and sized so as to physically and electrically contact a terminal post of an electrical storage battery over substantially all of said terminal post's circumferential area.

16. An improved connector for connecting an electrically conductive cable to the terminal post of a wet-cell storage battery to facilitate quick connection and disconnection therebetween, comprising:

attaching means for accomplishing physical and electrical connection to said electrically conductive cable;

opposably disposed operable jaw pieces, each one of said jaw pieces attached to one side of a one-piece, replaceable inner lining of conductive material having a substantially central portion thereof cut out for circumferentially contacting said terminal post of said storage battery;

biasing means for holding said inner lining clamped against said terminal post of said storage battery under constant tensions;

a positive electrical contact means for ensuring a positive electrical connection between the sides of said inner lining should said inner lining separate into two pieces physically; and releasing means for opposably operating said jaw pieces against said biasing means to release said connector from contact with said terminal post of said storage battery.

* * * * *